US008550546B2

(12) United States Patent
Breit

(10) Patent No.: US 8,550,546 B2
(45) Date of Patent: Oct. 8, 2013

(54) FOLDABLE SEATING APPARATUS

(76) Inventor: Bonnie Breit, Wallingford, PA (US)

( * ) Notice: Subject to any disclaimer, the term of this patent is extended or adjusted under 35 U.S.C. 154(b) by 773 days.

(21) Appl. No.: 12/545,844

(22) Filed: Nov. 12, 2009

(65) Prior Publication Data

US 2011/0109126 A1 May 12, 2011

(51) Int. Cl.
*A47D 1/02* (2006.01)

(52) U.S. Cl.
USPC ..... 297/60; 297/14; 297/333; 297/335

(58) Field of Classification Search
USPC ..... 297/14, 60, 333, 335
See application file for complete search history.

(56) References Cited

U.S. PATENT DOCUMENTS 841,565 A * 1/1907 Orr ..... 297/333
2,080,765 A * 5/1937 Croft ..... 297/60
2,088,644 A * 8/1937 Erpelding et al. ..... 297/60
3,120,976 A * 2/1964 Van Syoc ..... 297/60 X
6,109,696 A * 8/2000 Newhouse et al. .. 297/452.23 X
7,594,701 B2 * 9/2009 Kawabata et al. ..... 297/14

OTHER PUBLICATIONS

Photographs of Foldable Seating Apparatus Discovered by Applicant, Attached as "Appendix A," See Fig. 1 and Fig. 2 on pp. 1 and 2 Respectively.

* cited by examiner

*Primary Examiner* — Anthony D Barfield
(74) *Attorney, Agent, or Firm* — Brandon L. Underwood, LLC

(57) ABSTRACT

In various embodiments, a seating apparatus includes a seat member, a front leg assembly, a rear leg assembly, one or more attaching members for attaching the seating apparatus to a proximate structure and a rebound apparatus for returning the seat member from a deployed state to a retracted state. In various embodiments, the seating apparatus may further include a rebound regulation means, for regulating the rebound response of the seat, delivered by the rebound apparatus.

10 Claims, 13 Drawing Sheets

FOLDABLE SEATING APPARATUS

FIELD

Various embodiments relate to a seating apparatus, and more particularly to such a seating apparatus that is deployable and retractable.

BACKGROUND

Various seating apparatuses exist in the art for a variety of applications. These include the common four-legged chair found at dinner tables throughout the world, folding chairs such as portable "beach chairs" that must be folded and unfolded manually, as well as automatically folding chairs such as the "theater chairs" found in movie theaters and opera houses. With respect to the latter, that is chairs that are pivotally coupled at the rear of their seating surface to deploy or unfold when an occupant load is applied, and fold when the load is removed.

But, "theater chairs" are intentionally designed to not have four legs. That is, they specifically lack front legs, for many reasons. These reasons include the severe space constraints of where such chairs are typically installed (theater/auditorium seating rows), the added design complexity adding four legs would cause, cost and others. Yet the lack of four legs in "theater style" chairs limit the occupant load such chairs can accommodate.

In particular, such (theater style) chairs are not adapted to handle "impulse" type loads, such as what would occur if an occupant were to fall into the chair with their full body weight and momentum. The impulse force would create a moment of inertia and severe angular momentum about the seating surface's pivot point, which when it comes to the extent of its travel will create a severe impulse torque at the point and likely damage the seating apparatus. But, impulse loads are not typically encountered in theater environments, and thus (previously mentioned reasons why "theater chairs" do not have additional legs notwithstanding), "theater style" chairs continue to lack a suitable means for dealing with the aforementioned impulse forces, should they be encountered.

SUMMARY

In various embodiments, a seating apparatus includes a seat member, a front leg assembly, a rear leg assembly, one or more attaching members for attaching the seating apparatus to a proximate structure and a rebound apparatus for returning the seat member from a deployed state to a retracted state. In various embodiments, the seating apparatus may further include a rebound regulation means, for regulating the rebound response of the seat, delivered by the rebound apparatus.

BRIEF DESCRIPTION OF THE DRAWINGS

Further objects and advantages of the various embodiments to be described will become apparent from the following detailed description and drawings (not drawn to scale), in which.

Figure 1A:
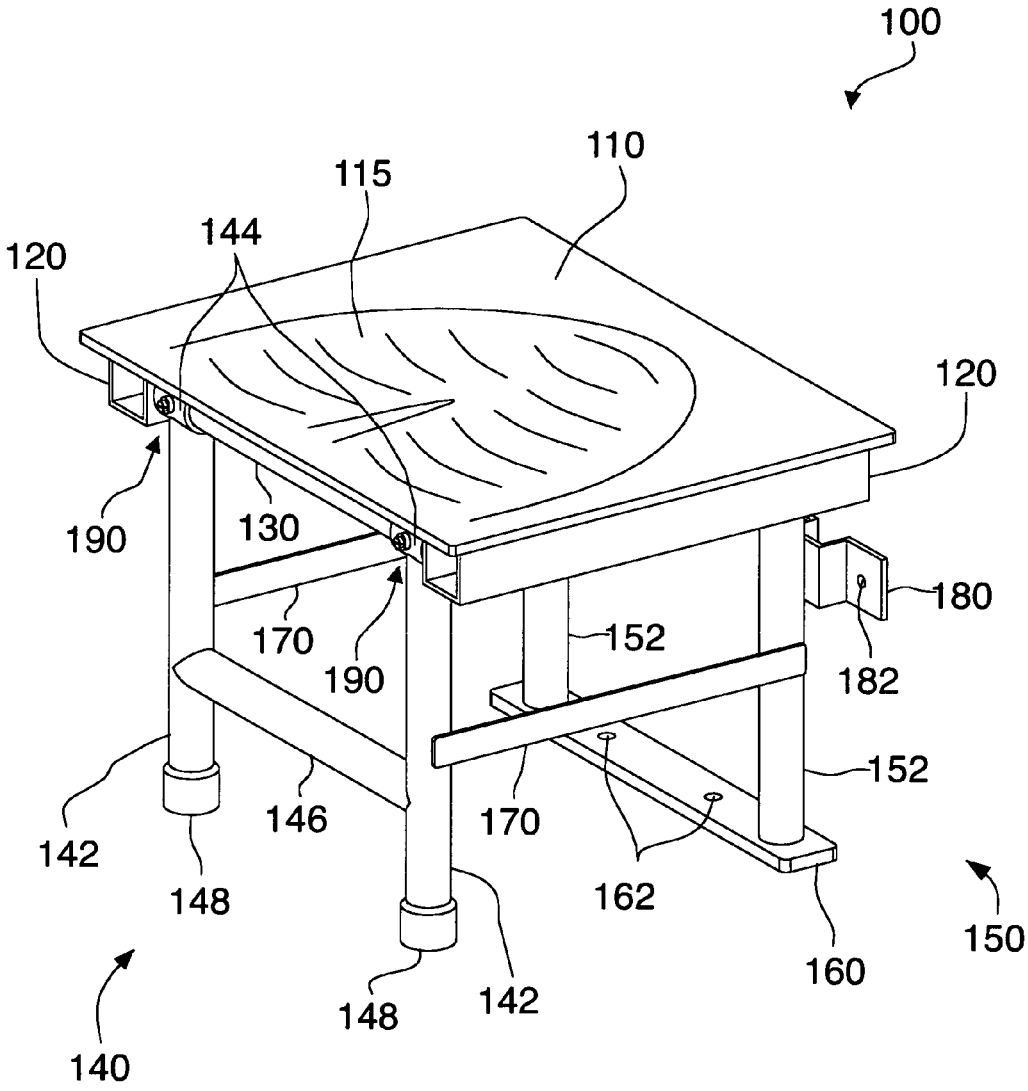
FIG. 1A depicts a perspective view of a seating apparatus 100 in a deployed orientation, according to one embodiment.

The first digit of each reference numeral in the above figures indicates the figure in which the element or feature is most prominently shown. The second digit indicates related elements or features, and a final letter (when used) indicates a sub-portion of the element or feature. To facilitate understanding, identical reference numerals have been used where possible, to designate identical elements that are common to the figures.

REFERENCE NUMERALS IN THE DRAWINGS

The following table lists reference numerals employed in the figures and identifies the element designated by each numeral.

TABLE

Reference Numeral Designations

| Reference Sign | FIG.(S) Within | Description |
|---|---|---|
| 100 | 1A, 1B, 1C, 1D, | Exemplary Seating Apparatus |
| 110 | 1A, 1B, 1C, 1D, 3, 4, 8B | Seat |
| 115 | 1A | Imprint |
| 120 | 1A, 1B, 1C, 1D | Transverse Member |
| 130 | 1A, 1B, 8B | Static Member |
| 140 | 1A | Front Leg Assembly |
| 142 | 1A, 1B, 1C, 1D, 2, 5, 7A | Front Support Member |
| 144 | 1A, 1B | Pivoting Member |
| 146 | 1A, 1B | Cross Member |
| 148 | 1A, 1B, 1C, 1D, 2, 3, 4, 5, 7A, 8B | Pad |
| 150 | 1A, 1C, 1D, 2, 3, 4 | Rear Leg Assembly |
| 152 | 1A, 1B, 1C, 1D, 3 | Rear Support Member |
| 160 | 1A, 1B, 1C, 1D, 3 | Base Member |
| 162 | 1A, 1B, 1C, 3 | Mounting Hole |
| 170 | 1A, 1B, 1C, 1D, 3, 5, 7A | Arm |
| 180 | 1A, 1B, 1C, 1D, 3 | Wall Mount |
| 182 | 3, 1A, 1B | Mounting Hole |

TABLE-continued

Reference Numeral Designations

| Reference Sign | FIG.(S) Within | Description |
|---|---|---|
| 190 | 1A, 1B, 1C, 1D | Exemplary Rebound Regulation Assembly |
| 192 | 1B, 3, 6 | Resilient Member |
| 194 | 1B, 3 | Seat End |
| 196 | 1B, 3 | Leg End |
| 198 | 1B, 3 | Hook |
| 200 | 2 | Exemplary Rebound Regulation Assembly Detail View |
| 210 | 2 | Passage |
| 220 | 2 | Adjustment Screw |
| 230 | 2 | Friction Member |
| 240 | 2 | Compression Chamber |
| 300 | 3, | Exemplary Seating Apparatus |
| 320 | 3, 4 | Transverse Member |
| 330 | 3, 4 | Pivot Arm |
| 340 | 3, 4, 7B | Pivot Sleeve |
| 342 | 3, 4, 5, 7B | Front Support Member |
| 352 | 3 | Rear Support Member |
| 360 | 3, 6 | Contact Member |
| 390 | 3 | Exemplary Rebound Regulation Assembly |
| 400 | 4 | Exemplary Rebound Regulation Assembly Detail View |
| 410 | 4 | Adjustment Screw |
| 420 | 4 | Expansion Chamber |
| 430 | 4 | Expansion Member |
| 432 | 4 | Rigid Member |
| 434 | 4 | Key Member |
| 436 | 4 | Hole |
| 440 | 4 | Hollow Portion |
| 500 | 5 | Exemplary Rebound Regulation Assembly |
| 510 | 5 | Adjustment Screw |
| 512 | 5 | Hole |
| 520 | 5 | Washer |
| 530 | 5 | End Member |
| 532 | 5 | Locking Section |
| 540 | 5 | Flat Friction Member |
| 600 | 6 | Exemplary Seating Apparatus |
| 610 | 6 | Reverse Torsion Member |
| 612 | 6 | Resilient Member |
| 614 | 6 | Seat End |
| 616 | 6 | Leg End |
| 620 | 6 | Sleeve |
| 700 | 7A | Exemplary Rebound Regulation Assembly Detail View |
| 710 | 7A | Rotary Damper |
| 712 | 7A | Male Member |
| 714 | 7A | Bolt Hole |
| 716 | 7A | Aperture |
| 720 | 7A | Mounting Fixture |
| 730 | 7A | Fastening Member |
| 740 | 7A | Washer |
| 750 | 7B | Exemplary Rebound Regulation Assembly, Detail View |
| 760 | 7B | Rotary Damper |
| 762 | 7B | Male Member |
| 770 | 7B | Transverse Member |
| 772 | 7B | Bolt Hole |
| 774 | 7B | Aperture |
| 780 | 7B | Backing Plate |
| 782 | 7B | Bolt Hole |
| 784 | 7B | Bolt |
| 790 | 7B | Pivot Arm |
| 792 | 7B | End |
| 794 | 7B | Aperture |
| 800 | 8A | Exemplary Seating Apparatus |
| 810 | 8A, 8B | Exemplary Rebound Stop Assembly |

TABLE-continued

Reference Numeral Designations

| Reference Sign | FIG.(S) Within | Description |
|---|---|---|
| 820 | 8B | Pivoting Member |
| 830 | 8B | Chassis |
| 840 | 8B | Cam Member |
| 842 | 8B | Cam Surface |
| 850 | 8B | Detent Member |
| 852 | 8B | Spring Loaded Wheel |
| 854 | 8B | Channel |

DETAILED DESCRIPTION

Various embodiments will generally be described within the context of seating apparatus adapted for use in a therapeutic environment, supporting human loads. But, those skilled in the art and informed by the teachings herein will realize that the basic scope is also applicable to seating apparatuses and weight supporting devices in general, adapted for installation in any type of environment, with any type of load.

Seating Apparatus, Exemplary Embodiment (FIGS. 1A-1D)

FIG. 1A depicts a perspective view of seating apparatus 100 in a deployed or unfolded position according to one embodiment. It shall be seen with respect to the forthcoming FIGs. and discussion seating apparatus 100 and the various other embodiments to be described are foldable and/or retractable.

Seating apparatus 100 includes a seat member 110, adapted to accept a downward directed load. In various embodiments, it is anticipated that this load will be the weight of a human occupant, but various embodiments may also be adapted to accommodate other and further loads and/or load types, without departing from the basic scope. Seating apparatus 100 further includes a front leg assembly 140 and a rear leg assembly 150. The front leg assembly 140 includes one or more elongated support members 142, or "legs," while rear leg assembly 152 similarly includes one or more elongated support members 152.

In one embodiment with respect to seating apparatus 100, front leg assembly includes a cross member 146 to provide lateral stability between the one or more legs 142. The seating apparatus 100 further includes cushioning pads 148 at the end of each leg 142 constructed of rubber, plastic or another pliable material, to prevent the legs 142 from damaging (e.g., scratching) the floor surface(s) they encounter when the seating apparatus 100 is deployed.

Front leg assembly (e.g., front leg assembly 140) provides a means for a seating apparatus such as seating apparatus 100 to independently support an occupant load, where according to various embodiments it is not necessary to place critical reliance on the integrity the structure to which the seating member is attached (which might not be known). This aspect of the embodiments will be further discussed with respect to base member 160 and/or wall mount 140. But, this stability is useful in embodiments where a seating apparatus (e.g., seating apparatus 100) is placed in a therapeutic environment, in which occupants may need to utilize the apparatus in response to being exerted and possibly in distress. In such instances, they may need to sit down quickly, or plop themselves into the seating apparatus, and have it deploys and comes to rest against their full body weight. A "theater" or similar type of seating apparatus (without a front leg assembly) is generally not suitable for handling such stresses, especially on a repetitive basis.

Figure 1B:
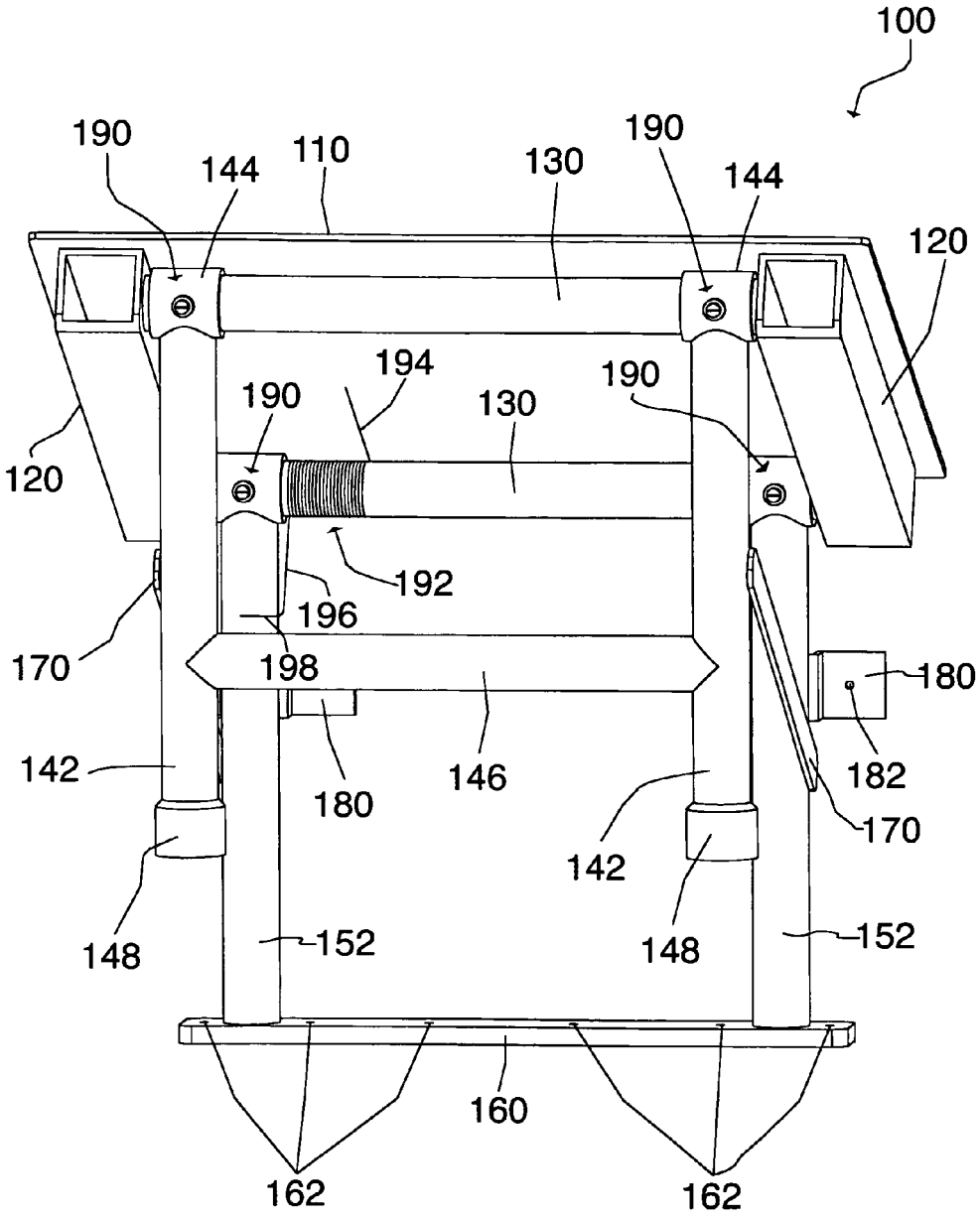
FIG. 1B depicts a perspective view of the seating apparatus 100 of FIG. 1A, in a partially folded orientation.
Figure 1C:
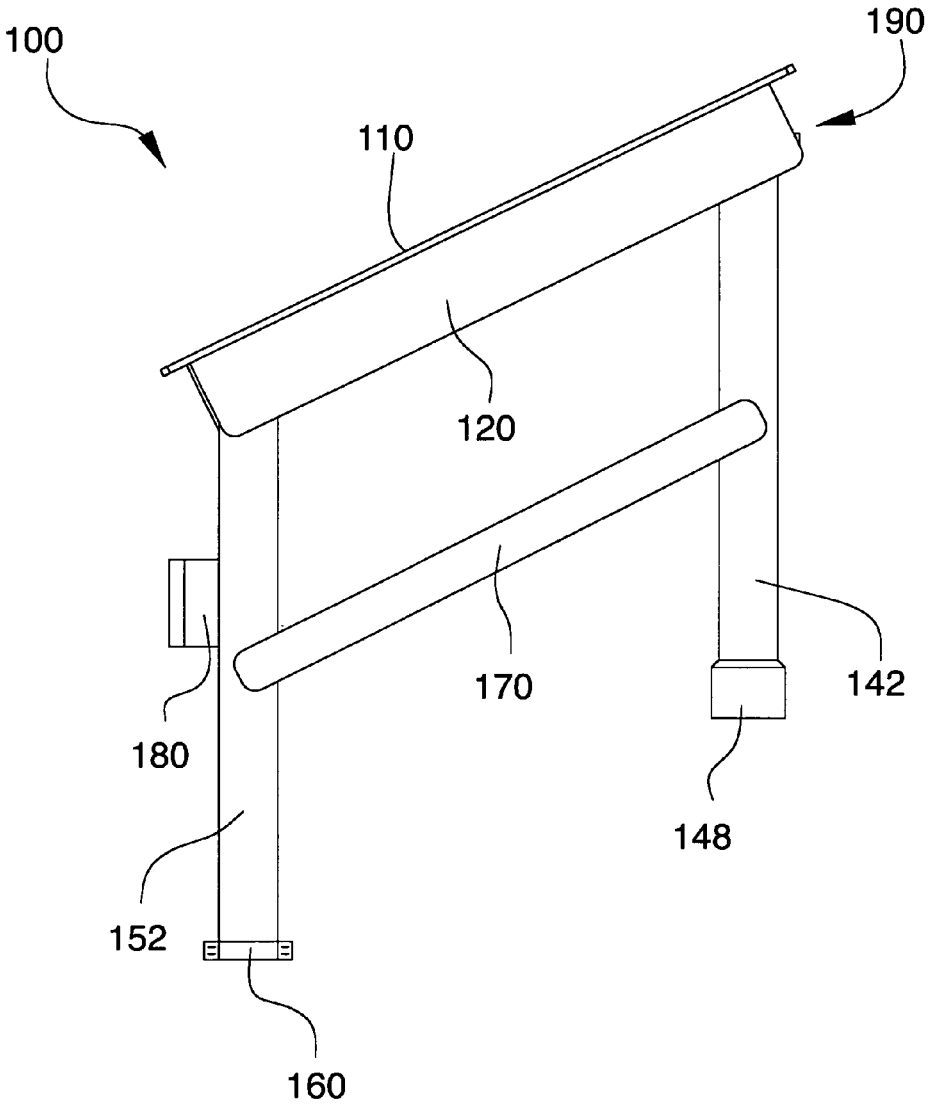
FIG. 1C depicts a side view of the seating apparatus 100 of FIGS. 1A and 1B, in a partially folded orientation.
Figure 1D:
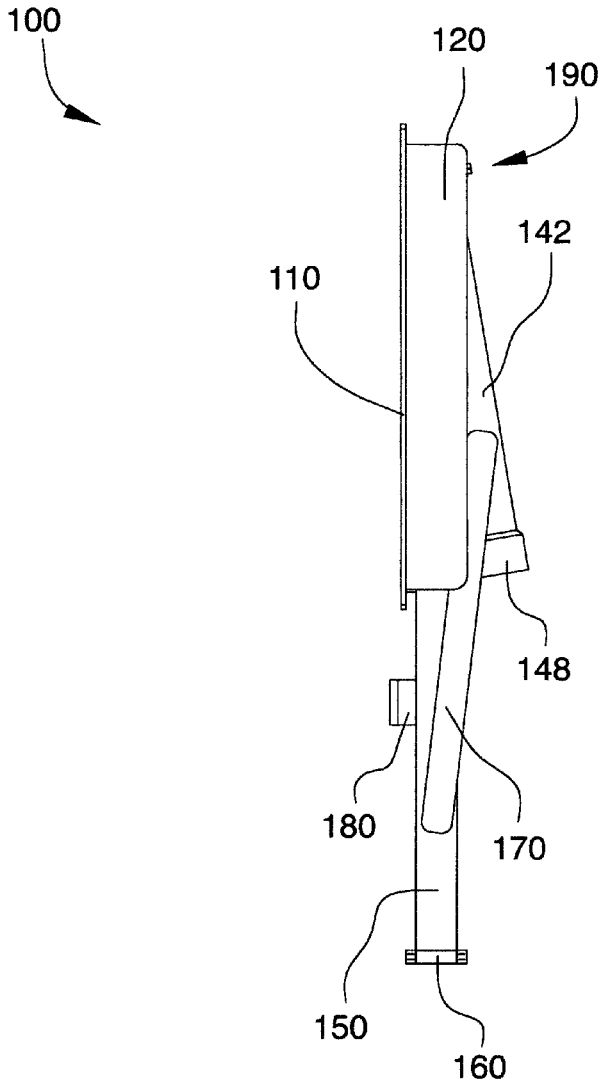
FIG. 1D depicts a side view of the seating apparatus 100 of FIGS. 1A, 1B and 1C, in a folded orientation.

Both the front leg assembly 140 and rear leg assembly 150 are pivotally coupled with respect to the seat member, thereby making seat assembly 100 "foldable" as previously discussed. FIG. 1B depicts a perspective view of the seating apparatus 100 in a partially folded position. FIG. 1C similarly depicts a side view of the seating apparatus 100 in a partially folded position, while FIG. 1D depicts a side view of the seating apparatus 100 in a fully folded position. FIGS. 1A-1D will be referred to and should be considered contemporaneously in the following discussion, as certain features of seating apparatus 100 are only visible in certain views and/or from certain angles.

Seating apparatus 100 includes two transverse members 120 on the underside of seat member 110, oriented from front-to-back on each side thereof. Both transverse members 120 are visible in FIGS. 1A and 1B, while only one transverse member 120 is visible in the side views of FIGS. 1C and 1D. Attached rigidly by each of their ends to transverse members 120 substantially in the front and back of, and across seating apparatus 100, are two static members 130. Ensleeving each of the static members 130 are one or more pivoting members 144 disposed at respective upper ends of the previously discussed one or more elongated support members 142 and 152, such that the pivoting members 144 respectively rotate about the static members 130 at the front and rear portions of the seat assembly, giving seating apparatus 100 its "folding" ability. A more detailed discussion of the operation of pivoting members 144 shall be provided with respect to FIG. 2.

In various embodiments, a foldable seating apparatus including front and rear leg assembly further includes a rebound apparatus for automatically returning the seat member from a deployed (unfolded) state to a retracted (folded) state. If placed in a narrow hallway or stairwell landing, this allows the seating surface (e.g., seat 110) to automatically move out of the way, such that it no longer encroaches upon the traffic flow and/or escape route in a fire/evacuation situation, which would pose a potential safety.

In one embodiment shown with respect to FIG. 1B, a rebound apparatus includes a resilient member 192. By way of example per the FIG., resilient member 192 comprises a spring. But, any suitable form of resilient member that returns the seat member from a deployed to a retracted may be utilized, such as a torsion member and/or shock assembly, as well as any number of resilient members in any suitable location(s), without departing from the basic scope. It is also contemplated that an electric motor or other suitable device may be utilized, in addition to or in place of the resilient member, to return the seat member from a deployed to a retraced state, while still remaining within the basic scope. With respect to the present example, the resilient member 192 depicted in FIG. 1B includes a seat end 194 and a leg end 196. Seat end 194 and leg end 196 are elongated straight segments of resilient member 192 that serve as contact points between the resilient member 192 with appropriate areas of seating apparatus 100, for returning the seat member 110 from a deployed to a retracted state.

Seat end 194 contacts the underside of seat member 110. Leg end 196 further includes a hook 198 that is placed in contact with the front side of a support member 148, such that when a deploying force (e.g., an occupant applying body weight to the top side of seat member 110) is applied to seating apparatus 100 and it travels into a deployed position, resilient member 192 is compressed. When the deploying force is removed, the resilient member 192 returns the seating apparatus 100 to a folded position.

In various embodiments, a seating apparatus further includes a rebound regulation means, for regulating the rebound response of the rebound apparatus such as resilient member 192. A rebound regulation means, according to various embodiments, controls the speed and/or time in/at which a seating apparatus (e.g., seating apparatus 100) returns from a deployed state to a retracted state. Controlling the rebound response is beneficial for users of such a seating apparatus who may be physically restricted or disabled, and a seat member returning (folding) to a retracted state too quickly after or immediately upon leaving the seat may pose a risk of injury to them.

In one embodiment, a rebound regulation means includes a rebound regulation assembly 190, shown with respect to seating apparatus 100 in FIG. 1B. Rebound regulation assembly 190 will be discussed in more detail with respect to FIG. 2, followed by discussion of other exemplary rebound regulation means in later sections.

In various embodiments, a seating apparatus also includes one or more attaching members for sturdily attaching the seating apparatus to a proximate structure such as a wall and/or floor. In one embodiment, seating apparatus 100 includes one or more wall mounts 180 and base member(s) 160 for respectfully attaching the apparatus to a wall and/or floor surfaces, Examples of which can be seen in FIGS. 1A-1D. Wall mount(s) 180 and base member(s) 160 respectively include mounting hole 182 and 162, by which the seating apparatus may be attached to a wall and/or floor with bolts or other suitable attaching means. Attaching members such as the wall mount(s) 180 and base member(s) 160 provide a means of stabilizing (e.g., providing lateral support to) the seating apparatus, in addition to that provided by the front and rear leg assemblies. Such additional stability may be useful both while the apparatus is subjected occupant loads (including impulse forces) and in instances where the apparatus may be reached for and relied upon for support, possibly in a panic situation, by an approaching occupant who may be close to or in the process of falling.

In various embodiments, a seating apparatus is constructed primarily of stainless steel, but other and further construction materials are also contemplated and may include any suitable material for constructing a sturdy apparatus, without departing from the basic scope. The stainless steel or a similar material may be desired in a therapeutic (e.g., a nursing home) environment, where occupants of the chair may suffer from incontinence and/or other ailments, and a seating apparatus therein should be easily cleanable and/or hypoallergenic.

In one embodiment, a seating apparatus further includes an imprint 115 disposed on the seat 110, wherein the imprint 115 substantially contours a human seating surface. That is, the imprint 115 is conformed to generally match the shape of a human rear end, so as to provide stability to and aid in preventing the occupant of the seating apparatus from slipping off the seat 110, as well as directs the occupant toward the center of the seat 110 as they sit down on it.

Figure 2:
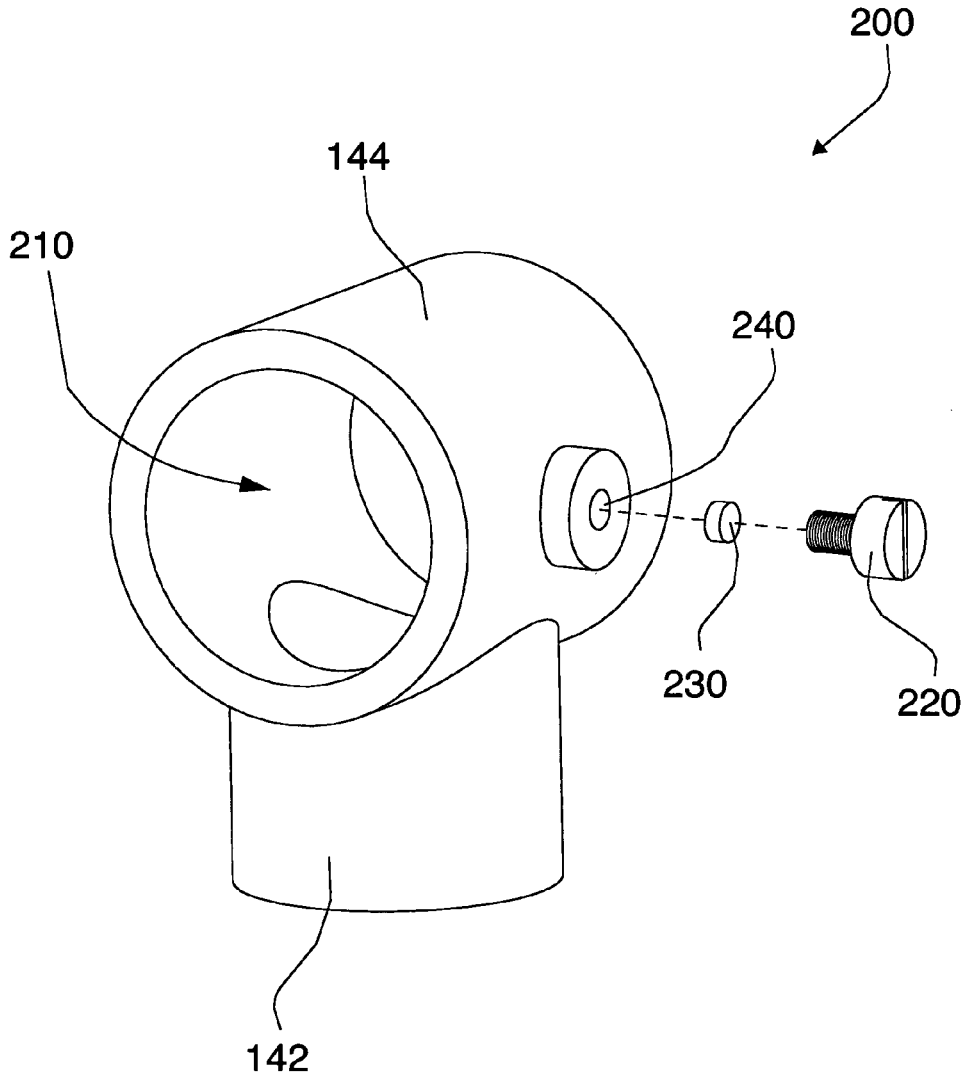
FIG. 2 depicts a detail view of an exemplary rebound regulation assembly 200, suitable for implementation in seating apparatus 100 of FIGS. 1A-D.

Rebound Regulation Apparatus, Exemplary Embodiment (FIG. 2)

FIG. 2 depicts an example of a rebound regulation means 200, according to one embodiment. As an example, the rebound regulation means 200 depicted in FIG. 2 is adapted for use with seating apparatus 100, but other variations of the general principles thereof may be utilized for seating apparatuses besides seating apparatus 100, without departing from the basic scope.

With respect to the present embodiment under discussion, FIG. 2 includes a close up break-away/partial view of pivoting member 144 of leg 142, discussed with respect to FIGS. 1A and 1B. In one embodiment, rebound regulation means 200 comprises a friction member 230 disposed on aforementioned pivoting member 144, the operation of which shall be described in more detail shortly.

In various embodiments, a seating apparatus (e.g., seating apparatus 100) may include pivoting members 144 and friction members 230 at respective upper ends of the one or more of the front support members 142 and/or rear support members 152. That is, a seating apparatus (e.g., seating apparatus 100) may have rebound regulations means(s) on either or both the front and rear leg assemblies 140 and 150.

As previously stated with respect to FIGS. 1A and 1B, pivoting member(s) 144 is/are adapted to rotate around a static member such as static member 130. In one embodiment with respect to FIG. 2, static member 130 is adapted to pass through a passage 210 of pivoting member 144, having a comparable inside diameter to static member 130's outside diameter. Rebound regulation means 200 includes a compression chamber 240, wherein the friction member 230 is inserted and permitted to come into contact with static member 130. The friction member 230 is pressed up against static member 130, whereby it regulates the rebound response or speed/timing of the return to a folded position of the seating apparatus (e.g., seating apparatus 100). In one embodiment, the friction member 230 is comprised of rubber. But, other and further materials (e.g., plastic) may be utilized for construction of the friction member 230 without departing from the basic scope, including any suitable material that produces a friction force against the static member 130, such that the rotation of pivoting member 144 and thereby the rebound response of the seating apparatus (e.g., seating apparatus 100) is suitably regulated as selected by an operator of the seating apparatus.

In various embodiments, the pressure or compressive force of friction member 230 against static member 130 is adjustable. In one embodiment the pressure of friction member 230 is adjusted via an adjustment screw 220, which directs a selected compressive force into the compression chamber. The greater the penetration of adjustment screw 220 into chamber 240, the greater the frictional force produced between friction member 230 and static member 130, and correspondingly, the greater the regulation of the rebound response.

In various embodiments, the friction member 230 may also be spring loaded or otherwise compressed by a resilient member into the chamber 240, to maintain consistent pressure of the friction member 230 against the static member 130, as the friction member 230 potentially wears (depending upon its material) or otherwise loses its effectiveness.

Figure 3:
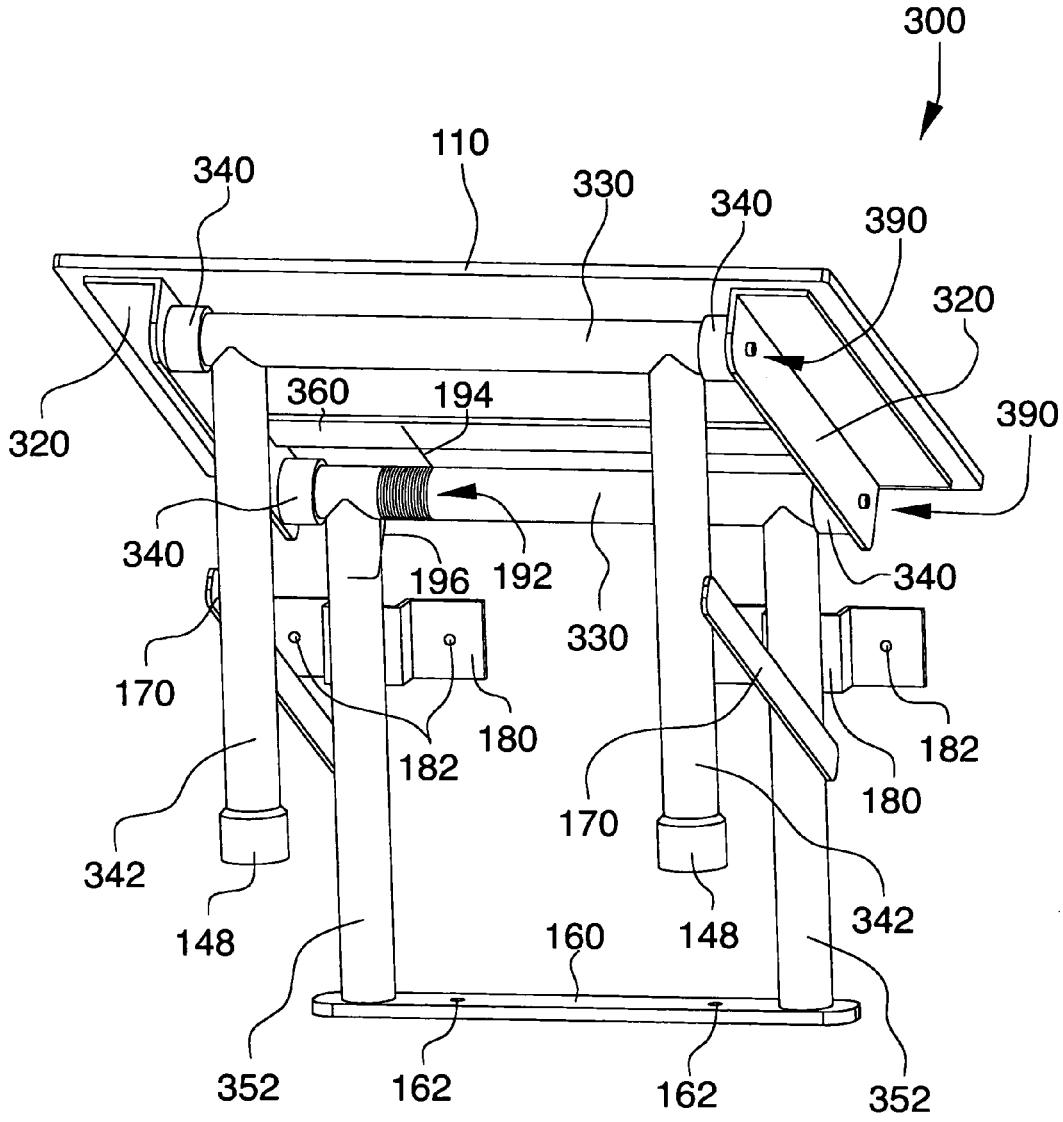
FIG. 3 depicts a perspective view of a seating apparatus 300, according to one embodiment.

Seating Apparatus, Alternate Exemplary Embodiment(s) (FIG. 3)

FIG. 3 depicts a perspective view of a seating apparatus 300, according to one embodiment. FIG. 3 includes similar features to seating apparatus, in that it includes a seat member 110; front and rear leg assemblies each with one or more elongated support members (to be discussed); attaching members (base member 160 wall mounts 180) for attaching the seating apparatus to a proximate structure; and, a rebound regulation assembly 190 for returning the seat member from a deployed state to a retracted state. But, the structural components of the seating apparatus are rearranged and an alternate rebound regulation means incorporated according to one embodiment.

Seating apparatus 300 includes a pivot arm 330 disposed at respective upper ends of the one or more elongated support members of each of the front and rear leg assemblies. Depending upon whether the pivot arm is located on the front or leg assembly, it may be referred to as either a front or rear pivot arm respectively, but both perform a similar function in each instance. The front and rear leg assemblies respectively include front elongated support members 342 (legs) and rear elongated support members 352 (legs).

Each edge of the underside of seat member 110 includes a transverse member 320, having a pivot sleeve 340 disposed at the front and rear of ends of transverse member 320, positioned at and enclosing the respective ends of the pivot arm(s) 330. The front and rear pivot arms 330 each rotate within the front and rear pivot sleeves 340. Unlike exemplary seating apparatus 100, exemplary seating apparatus 300 does not include a "cross member" such as cross member 146, and may be easier to manufacture than seating apparatus 100 according to various embodiments. Exemplary seating apparatus 300 also includes a contact member 360 on the underside of seat member 110, which serves as a contact point for seat end 194 and handles the force of resilient member 192.

Exemplary seating apparatus 300 further includes a rebound regulation assembly 390 for regulating the rebound response with respect to seating apparatus architectures such as exemplary seating apparatus 300. Rebound regulation assembly 390 will be discussed in detail with respect to FIG. 4.

Figure 4:
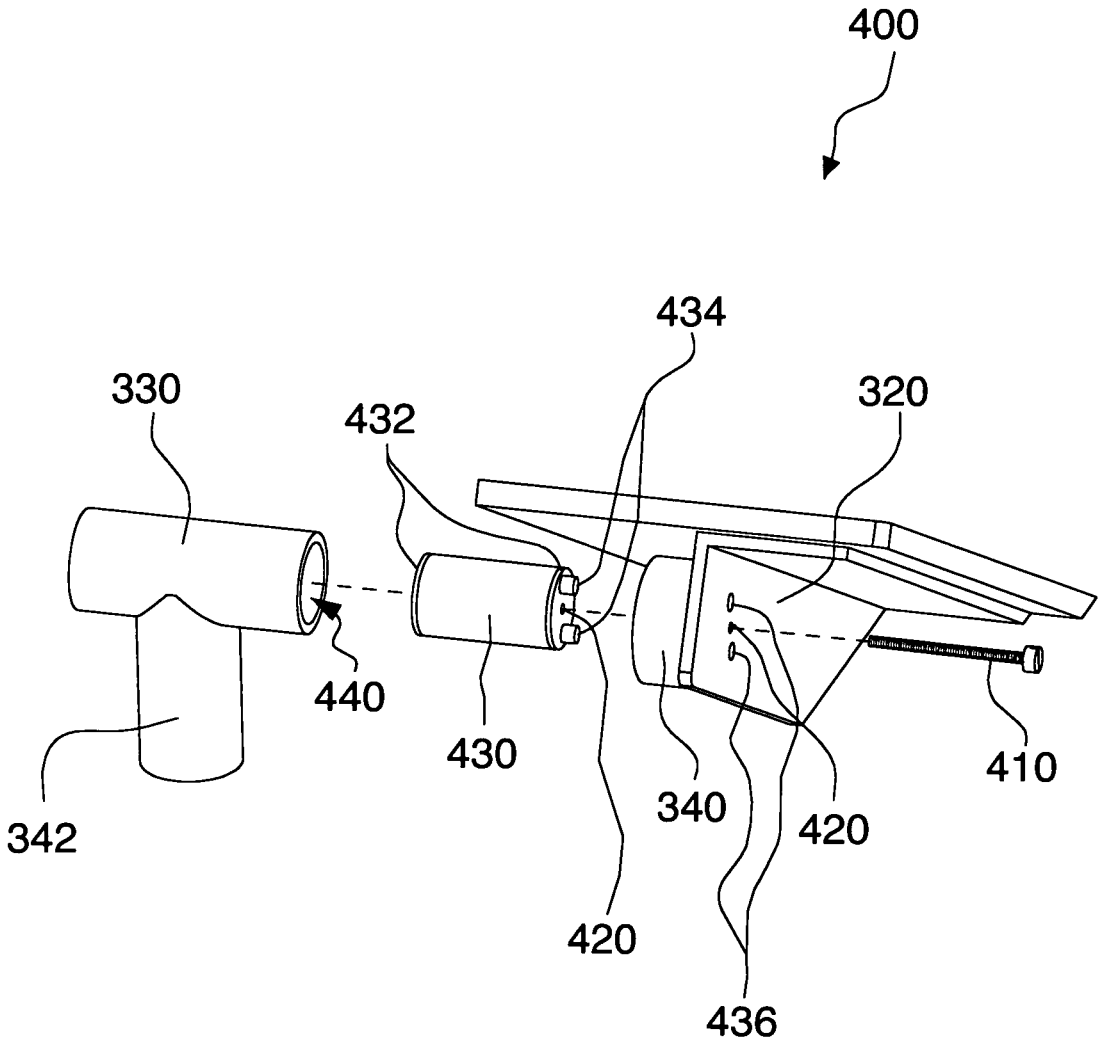
FIG. 4 depicts a detail view of an exemplary rebound regulation assembly 400, suitable for implementation in seating apparatus 300 of FIG. 3 according to one embodiment.

Rebound Regulation Apparatus, Alternate Exemplary Embodiment (FIG. 4)

FIG. 4 depicts a detail view of an exemplary rebound regulation assembly 400, suitable for functioning as rebound regulation means 390 of FIG. 3, according to one embodiment. It is contemplated however, that other and further embodiments of rebound regulation assemblies in accordance with the general principals of rebound regulation assembly 390/400 may be implemented on other embodiments of seating apparatus, to include any suitable means of regulating the rebound response(s) thereof, without departing form the basic scope.

With respect to exemplary rebound regulation means 390 and/or 400, FIG. 4 includes a close up break-away/partial view of transverse member 320, a portion of pivot arm 330, pivot sleeve 340 and a portion of elongated support member 342, discussed with respect to exemplary seating apparatus 300. Exemplary seating apparatus 300, as it was depicted with respect to FIG. 3, should accordingly be considered with respect to the following discussion of rebound regulation assembly 400.

In one embodiment, or more the front or rear pivot arms of a seating apparatus such as front and/or rear pivot arms 330 of seating apparatus 300 includes a hollow portion 440. An expansion member 430 or plug is placed and serves as a friction member within hollow portion 440. In various embodiments, the expansion member 430 is adjustable. In one embodiment, the expansion member 430 is adjusted via an adjustment screw 410, adapted to compress and thereby expand and thereby regulate the friction produced the inner surface of hollow portion 440 by expansion member 430. Adjustment screw 410 passes through a hole 420 and into expansion member 430. Expansion member 430 includes rigid members 432 on each end. The rigid member 432 farthest away from hole 420 is threaded so as to accept adjustment screw 410 and compress expansion member 430 as it (via adjustment screw 410) is tightened. As expansion member 430 is compressed, it expands outwardly against an inner surface of the hollow portion to thereby regulate the rebound response of the seating apparatus 300.

In one embodiment, expansion member 430 is held in place against traverse member 320 and thereby prevented from rotating in hollow portion 440, by one or more key members 434 on the outer side of one or more of the rigid members 432 that insert into corresponding holes 436 in the transverse member 320. In addition to providing rotational stability to expansion member 430, key(s) 434 inserting into hole(s) provide a visual indicator of whether or not the expansion member (430) is securely positioned against the transverse member 320. However, other and further methods of securing expansion member 430 against traverse 320 and/or preventing it from rotating in hollow portion 440, are also contemplated and within the basic scope. Those include a slot or key on the top of the expansion member and/or rigid members 432, reversing the position of the key members 434 and holes 436, or any suitable means of holding the expansion member 430 in place within hollow portion 440.

Figure 5:
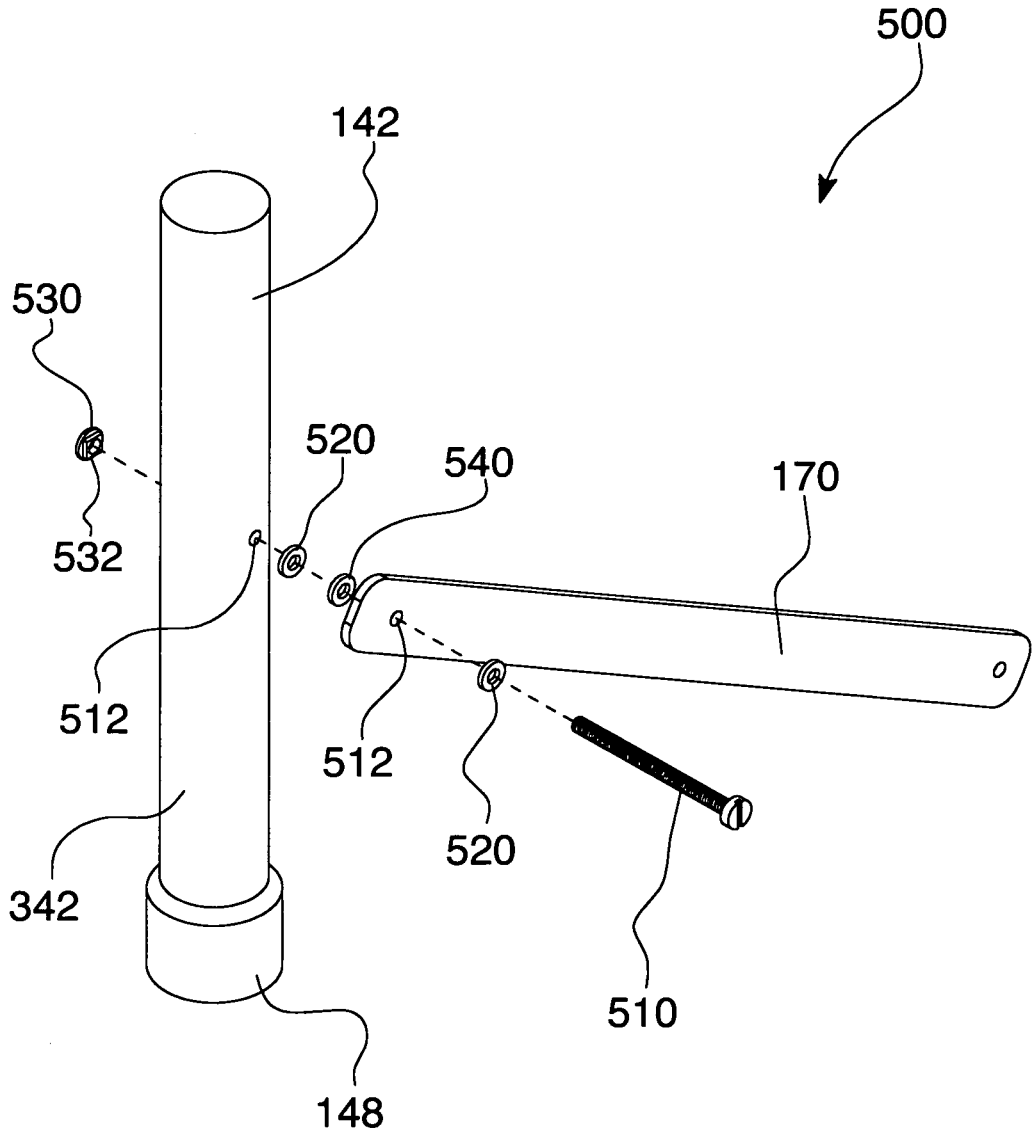
FIG. 5 depicts a detail view of an exemplary rebound regulation assembly 500, suitable for implementation in seating apparatus 100 of FIGS. 1A-C and others, according to one embodiment.

Rebound Regulation Apparatus, Alternate Exemplary Embodiment (FIG. 5)

FIG. 5 depicts a detail view of an exemplary rebound regulation assembly 500, adapted to function with multiple seating apparatuses that may be constructed according to various embodiments. By way of example, rebound regulation assembly 500 shall presently be described with respect to seating apparatus 300. But, the general principles of the regulation assembly 500 may be utilized in any suitable, with respect to ay other seating apparatus(es), without departing from the basic scope.

In one embodiment, rebound regulation assembly 500 functions in conjunction with arm 170 and front support member (leg) 342, discussed with respect to seating apparatus 300. In general, rebound regulation assembly 500 operates by positioning and compressing a flat friction member 540 between arm 170 and support 342.

With respect to the exemplary arrangement of FIG. 5, the friction member 540 may be accomplished as follows. Arm 170 and support member 342 each include a hole 512, adapted/sized to accommodate an adjustment screw 510. Adjustment screw 510 passes first through a washer 520, followed by arm 170, then flat friction member 540, then another washer 520, then support member 342, and finally terminates at a female end member 530 having matching threads that couple with those of adjustment screw 510. End member 530 includes a locking section 532, which is comprised of a square section thereof that is adapted to be inserted/secured into a matching square keyway (not shown) on the inward side of support member 432, to thereby prevent the end member 530 from turning as adjustment screw 510 is turned.

As adjustment screw 510 is tightened, arm 170 is compressed with greater and greater force against support member 342, with flat friction member 540 between the two. As this increasing compression occurs, the friction between arm 170 and support member 342 is increased, thus regulating the rebound response of the seating apparatus (e.g., exemplary seating apparatus 300) in an adjustable manner.

Figure 6:
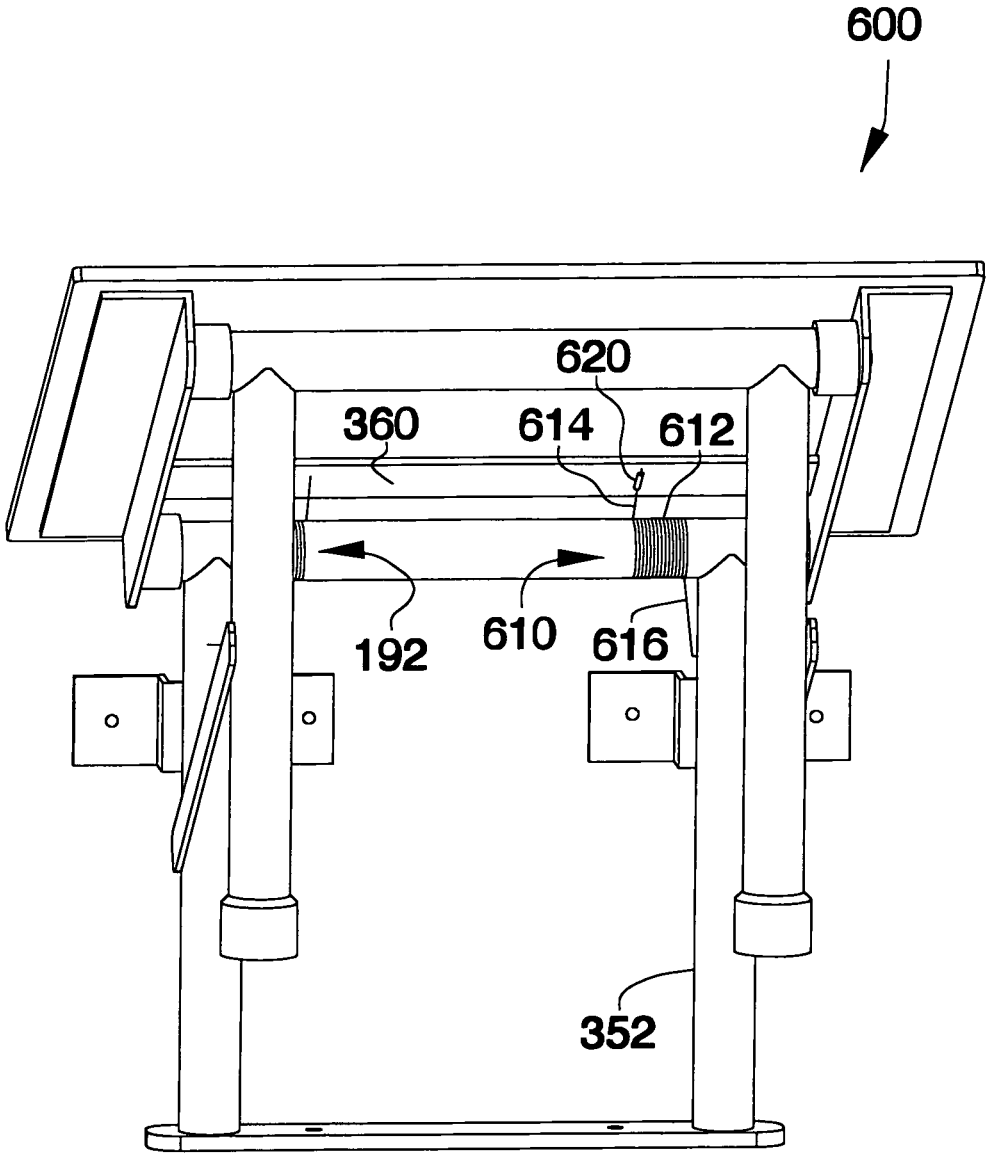
FIG. 6 depicts a detail view of an exemplary seating apparatus 600, having an exemplary reverse torsion rebound regulation assembly according to one embodiment.

Rebound Regulation Apparatus, Alternate Exemplary Embodiment (FIG. 6)

FIG. 6 depicts an exemplary seating apparatus 600, according to one embodiment. Seating apparatus 600 includes similar structural members to seating apparatus 300 (e.g., seat, front support members, rear support members, etc.). In one embodiment, exemplary seating apparatus additionally includes a rebound regulation means comprised of a double torsion spring assembly, which shall be explained below.

Exemplary seating apparatus 600 includes a resilient member 192, or suitable equivalent, for returning the seating apparatus from a retracted to a folded position as previously described. Furthermore, seating apparatus 600 includes a reverse torsion member 610, for regulating the rebound response of the resilient member 192 (or suitable equivalent) according to one embodiment.

In one embodiment, reverse torsion member 610 includes a second resilient member 612, which may be a spring or similar component. In various embodiments, resilient member 612 includes a seat end 614 and a leg end 616. In general, reverse torsion member 610 is adapted to oppose the motion of resilient 192 or other rebound apparatus, so as to regulate the overall rebound response of the seating apparatus.

In one embodiment, the rebound regulation function is accomplished by inserting seat end 614 into a sleeve 620, disposed on the underside of contact member 360, while leg end 616 is positioned to the rear side of a leg member 352 Resultantly, reverse torsion member 610 applies a contrary force directed at deploying the exemplary seating apparatus 600, which opposes to the force delivered by resilient member 192 that tends to fold the seating apparatus 600.

In various embodiments, a rebound assembly such as resilient member 192 is adapted to apply a stronger folding force than the deploying force of reverse torsion member 610. In one embodiment, where the resilient members 192 and reverse torsion member 610 are comprised of springs and/or other similar components, the spring constant 'k' (according to Hooke's law describing the mechanical behavior of springs) for rebound assembly 192 may be selected to have a higher value than the that of reverse torsion member 610 thereby slowing and/or delaying folding action or rebound response of the seating apparatus 610.

It should also be emphasized that other and further embodiments are also contemplated in addition to the exemplary embodiment displayed in FIG. 6 that remain within the basic scope. While FIG. 6 displays a rebound regulation means comprising a reverse torsion member having two separate resilient members (192 and 612), for example, other embodiments are also contemplated that achieve the same function with a single consolidated resilient or spring member. The reverse torsion arrangement may also be implemented using torsion bars (not shown) instead of springs, or any suitable other means of providing folding and/or retracting forces to the seating apparatus 600 other various embodiments.

Figure 7A:
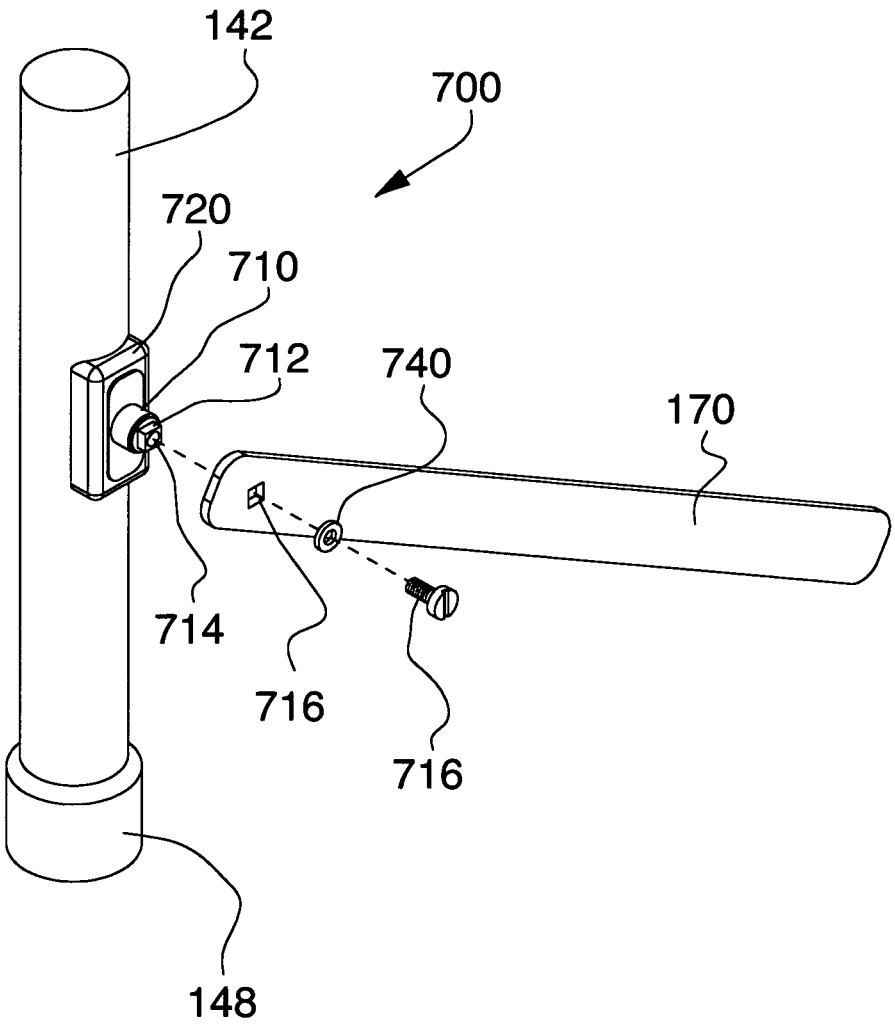
FIG. 7A depicts a detail view of an exemplary rebound regulation assembly 700, suitable for implementation in seating apparatus 100 of FIGS. 1A-C and others according to one embodiment.

Rebound Regulation Apparatus, Alternate Exemplary Embodiment (FIG. 7A)

FIG. 7A depicts an exemplary rebound regulation assembly 700, according to one embodiment. In rebound regulation assembly 700, the rebound regulation means comprises a rotary damper. In various embodiments, the rotary damper may include a viscous rotary damper and/or any suitable alternative that generally controls the rebound speed of the seating apparatus as it returns to a folded position.

For purpose of example, rebound regulation assembly 700 is depicted as functioning with respect to a seating apparatus such as exemplary seating apparatus 100. Specifically, rebound regulation assembly 700 is adapted to function with a seating apparatus having an arm member such as arm member 170 of seating apparatus 100, or a similar structure pivotally coupled to one or more support members such as support member(s) 142 and 152.

By way of example, FIG. 7A displays a partial breakaway view of various components of exemplary seating apparatus 100, pertinent to the operation of rebound regulation assembly 700. Specifically, those components include a support member 142 and arm member 170. It is also contemplated however, that rebound regulation assembly 700 may be similarly implemented on other and further seating apparatuses besides exemplary seating apparatus 100, without departing from the basic scope.

Rebound regulation assembly 700 includes a rotary damper 710, a male member 712, bolt Hole 714, an aperture 716, a mounting fixture 720, a fastening member 730, and a washer 740. In one embodiment shown as an example in FIG. 7A, rebound regulation assembly 700 is adapted for incorporation within exemplary seating apparatus 100, or other similar embodiments, wherein the rotary damper 710 is coupled with one or more arm members 170.

In the present example with respect to rebound regulation assembly 700, mounting fixture 720 is attached to leg 142. In various embodiments, mounting fixture 720 may be adapted to conform to a leg assembly such as leg 142 as shown in FIG. 7A, but any suitable means of attachment may also be utilized. Mounting fixture 720 includes a flat mounting surface on its outer side, to which rotary damper 710 attached.

Rotary damper 710 includes a rotating male member 712, which inserts into an aperture 716 in the arm member 170. In the embodiment shown with respect to FIG. 7A, male member 712 and aperture 716 have comparably sized square outer and inner dimensions respectively, such that male member 712 mechanically couples with aperture 716, and causes the rotary damper 712 to rotate about (i.e., function as a pivot point for) the arm 170 when the seating apparatus 100 folds and unfolds. The square inner and outer dimensions of male member 712 and aperture 716 may be substituted for any suitable shape (e.g., star drive, Allen key, gear assembly, etc), without departing from the basic scope.

In the present example with respect to FIG. 7A, arm member 170 is secured to rotary damper 710 with a bolt 730, which is inserted into a bolt hole 714. It is also contemplated however, that the arm member 170 (or equivalent structure) may be fastened to the rotary damper by other and further means, to include any suitable means, without departing from the basic scope. Washer 740 is positioned between the head of bolt 730 and arm 170, as a barrier between the rotation of arm 170 and the head of bolt 730.

In various embodiments, the rotary dampers utilized in the seating apparatuses described herein are "one-way" rotary dampers. That is, the rotary dampers regulate the rebound response of the seating apparatus while it returns to a folded from a deployed position, but does not affect the motion of the seating apparatus while it is traveling to a deployed position. Yet, it is also contemplated that any type of rotary damper may be utilized to regulate the rebound response (including "two-way" rotary dampers), in any suitable installation configuration, without departing from the basic scope.

Figure 7B:
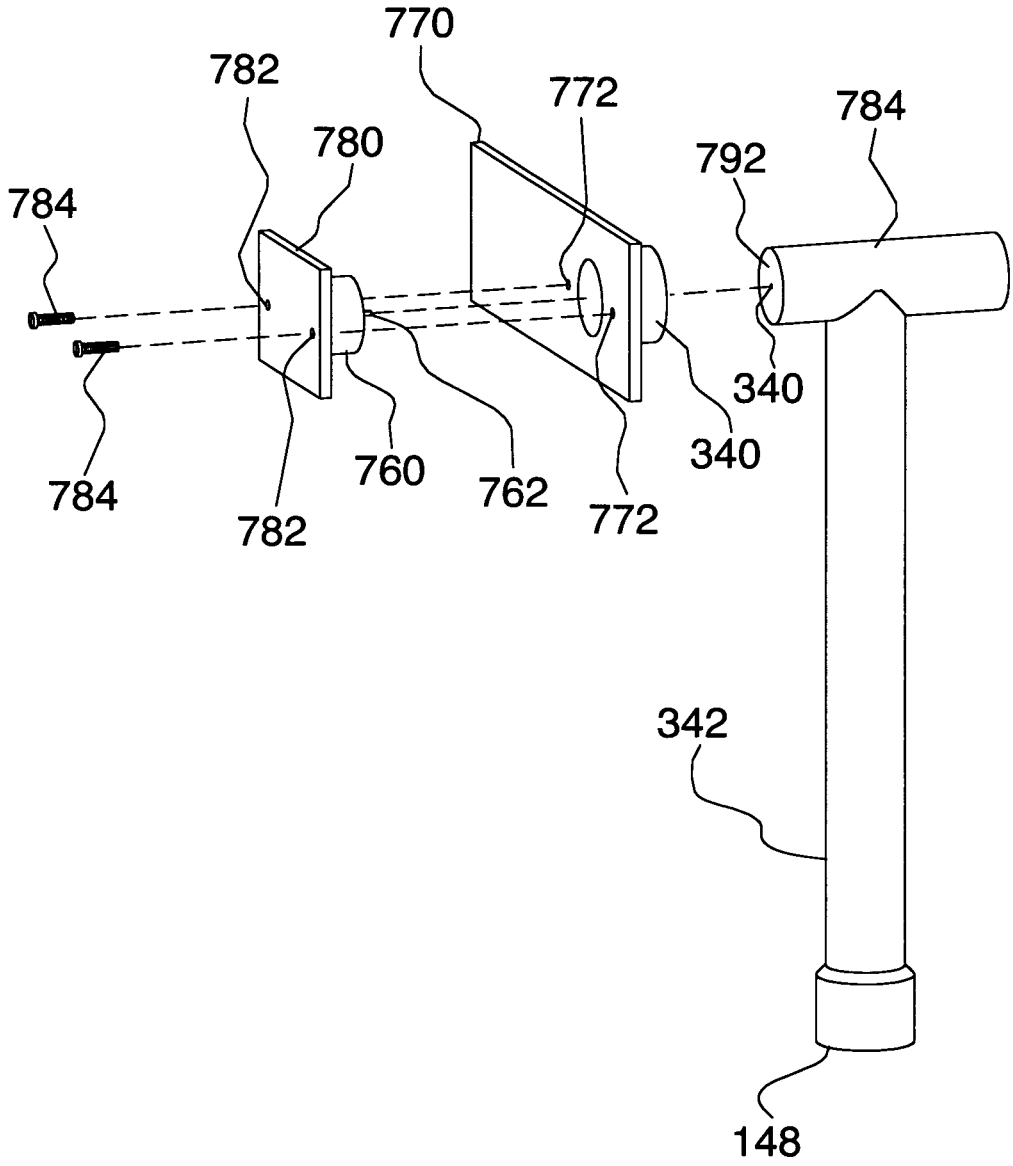
FIG. 7B depicts a detail view of an exemplary rebound regulation assembly 750, suitable for implementation in seating apparatus 300 of FIG. 3 and others, according to one embodiment.

Rebound Regulation Apparatus, Alternate Exemplary Embodiment (FIG. 7B)

FIG. 7B depicts a detail view of an exemplary rebound regulation assembly 750, according to one embodiment. Like exemplary rebound regulation assembly 700, the rebound regulation means of exemplary rebound regulation assembly 750 comprises a rotary damper. But, rebound regulation assembly 750 is adapted for implementation in seating apparatuses either with or without arm members (e.g., arms 170 of exemplary seating apparatus 100).

The detail view of exemplary rebound regulation assembly 750 in FIG. 7B displays a rotary damper 760, attached or affixed to a backing plate 780. The rotary damper 760 passes through an aperture 774 in a transverse member 770. Transverse member 770 is essentially suitable for serving as transverse member 320 of exemplary seating apparatus 300, but with the addition of the aperture 774.

In one embodiment, the assembly of backing plate 780 and rotary damper 760 are affixed to the transverse member 770 with bolts 784, which pass through and/or are threaded into bolt holes 782 and 772. 23. The backing plate 780 and rotary damper 760 are thus removable from the transverse member, providing for easy serviceability and/or replacement of the rotary damper if/as required.

When the backing plate 780 and rotary damper 760 are respectively positioned against and through the transverse member 770, the rotary damper is enclosed by or disposed in a pivot sleeve 340, such as has been described with respect to FIG. 3. A pivot arm 790, which is essentially suitable for serving as pivot arm 330 of FIG. 4, is inserted at its end 792 into the pivot sleeve 340, as pivot arm 330 was described as being inserted into pivot sleeve 340. Pivot arm 790 includes a front support member 340, just as does pivot arm 330, described with respect to FIG. 3.

The end 792 of pivot arm 790 includes an aperture 794, wherein a male member 762 of rotary damper 760 is inserted and couples therewith. In this manner, the rotary damper 760 regulates the rebound response of the seating apparatus 750, as the chair moves from its retracted to folded position. By, having the end 792 of pivot arm 790 inserted into pivot sleeve 340, the pivot sleeve 340 absorbs all or most of the lateral forces caused by the occupant load of the seating apparatus 750. The force(s) exerted on the rotary damper 360, thus remain only rotational (instead of lateral), reducing the mechanical stress the damper 360 is subjected to.

Figure 8A:
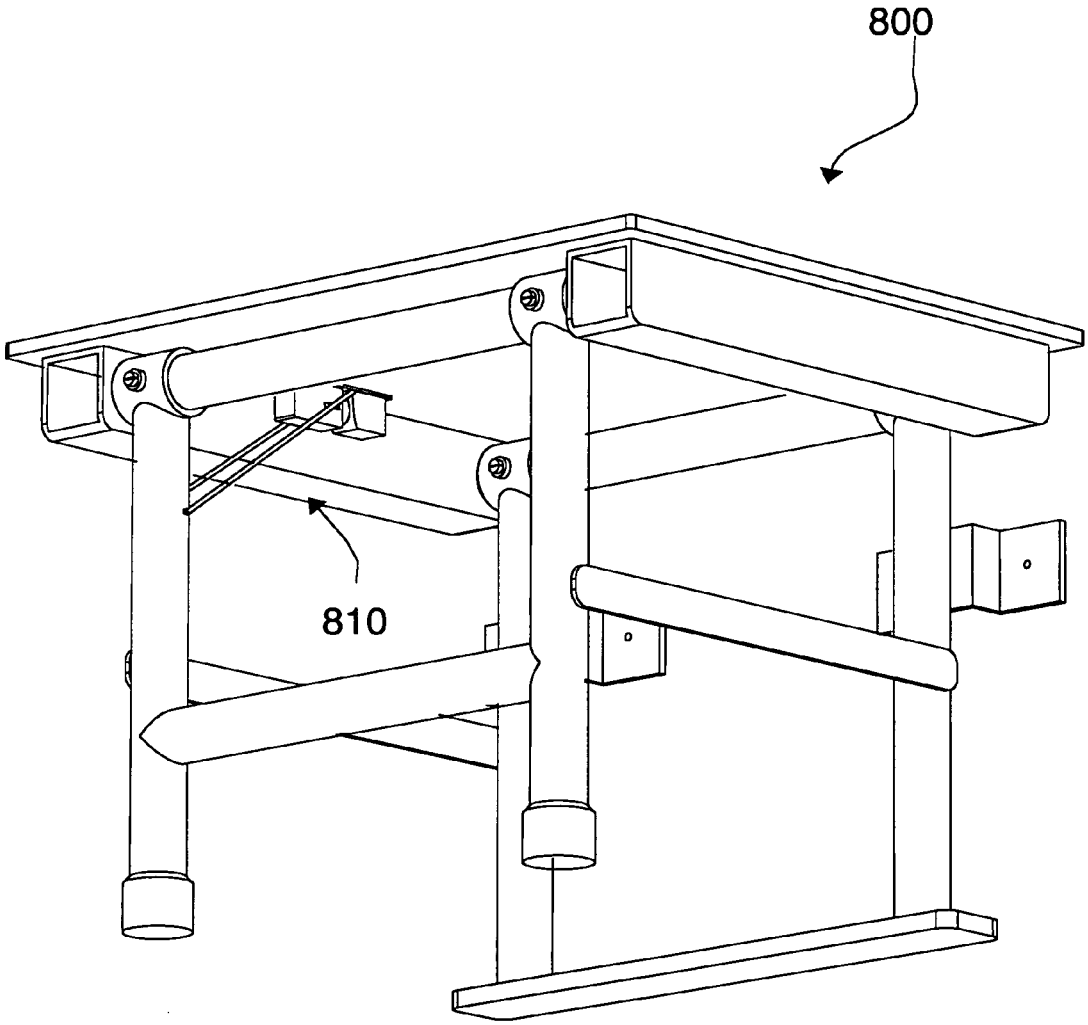
FIG. 8A depicts a perspective view of an exemplary seating apparatus 800, having an exemplary rebound stop assembly 810 according to on embodiment.
Figure 8B:
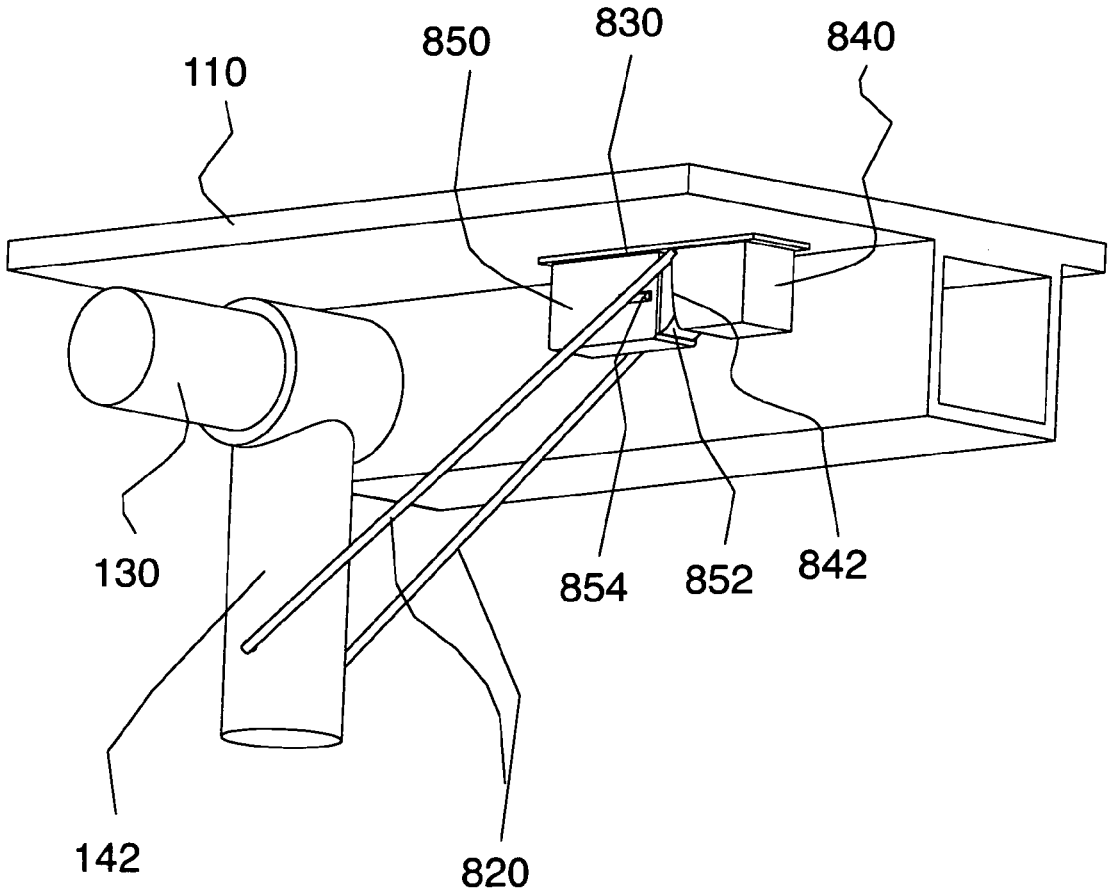
FIG. 8B depicts a detail view of the exemplary rebound stop assembly 810 of FIG. 8B.

Rebound Stop Assembly, Exemplary Embodiment (FIGS. 8A and 8B)

In various embodiments, a seating apparatus further includes a rebound stop assembly, for selectively stopping the seating apparatus from returning to a folded from a retracted position FIG. 8A depicts an exemplary seating apparatus 800 having an exemplary rebound stop assembly 810 according to one embodiment. By way of example, exemplary seating apparatus 800 is suitable for functioning as exemplary seating apparatus 100 of FIG. 1, but it is also contemplated that a stop assembly such as stop assembly 810 or another suitable embodiment thereof may be included on other and further seating apparatuses, without departing from the basic scope.

FIG. 8B depicts a detailed view of the exemplary rebound stop assembly 810 shown in FIG. 8A. Exemplary rebound stop assembly 810 includes a pivoting member 820, chassis 830, cam member 840 and detent member 850, according to one embodiment. By way of example, FIG. 8B depicts portions of certain components of exemplary seating apparatus 100, useful in demonstrating the operation of rebound stop assembly 810 with respect to an embodiment that has been discussed herein. But as mentioned, rebound stop assembly 810 is not relegated to only functioning with seating apparatus 100.

Specifically, FIG. 8B depicts portions seat 110, static member 130, leg 142 and pivoting member 144, of seating apparatus 100, with rebound stop assembly 810 in an engaged state. That is, the rebound stop assembly 810 is configured to stop the seating apparatus 100 from returning to a folded from a deployed position.

As previously mentioned with respect to various rebound regulation assemblies discussed herein, when seating apparatus 100 and similar embodiments thereto are placed in a folded position, their front legs (e.g., legs 142) pivot or fold inward toward the bottom of the seating surface (e.g., seat 110). Rebound stop assembly 810 is adapted to stop this motion.

Pivoting member 820 is pivotally attached to leg 142 (or another leg member depending upon embodiment). When rebound stop assembly 810 is in an engaged state, as shown in FIG. 8B, pivoting member 820 contacts cam member 840, having a cam surface 842. Cam surface 842 is curved outward toward the front leg assembly of the seating apparatus (e.g., seating apparatus 100), which provides a gradual compressive force to the pivoting member 820 that fully deploys the seating apparatus, should an operator attempt to move the pivoting member 820 into its upward or engaged position if the seating apparatus is not fully deployed.

When moved upward, pivoting member 820 travels through a detent member 850, including a spring loaded wheel 852, applying a compressive force against the cam member 840. The spring loaded wheel 852 moves longitudinally with respect to the cam member 840, through a channel 854. Cam member 840 and detent member 850 are mounted on chassis 830, which attaches to the underside of the seating (e.g., seating surface 110). The compression of spring loaded wheel 852 against cam surface 842 holds pivoting member 820 its upward position according to one embodiment, while the exemplary rebound stop assembly 810 is engaged.

CONCLUSION

It will be apparent to those skilled in the art that the objective of various embodiments have been achieved as described hereinbefore, by providing a seating apparatus including a seat member, a front leg assembly, a rear leg assembly, one or more attaching members for attaching the seating apparatus to a proximate structure and a rebound apparatus for returning the seat member from a deployed state to a retracted state.

Various changes may be made to the structure and embodiments shown herein without departing from the general concept of the described various embodiments. Further, features of embodiments shown in various figures may be employed in combination with embodiments shown in other figures. Therefore, the scope of the invention is to be determined by the terminology in the following claims and the legal equivalents thereof.

What is claimed is:

1. A seating apparatus, comprising:

a seat member;

a front leg assembly, including one or more elongated support members, pivotally coupled with respect to the seat member;

a rear leg assembly, including one or more elongated support members, pivotally coupled with respect to the seat member;

one or more attaching members for attaching the seating apparatus to a proximate structure;

a rebound apparatus for returning the seat member from a deployed state to a retracted state; and a rebound regulation means, for regulating the rebound response of the rebound apparatus; wherein, the rebound regulation means regulates the speed at which the seating apparatus returns from the deployed state to the retracted state.

2. The seating apparatus of claim 1, wherein the rebound apparatus comprises a resilient member.

3. The seating apparatus of claim 2, wherein the resilient member comprises a spring assembly.

4. The seating apparatus of claim 3, wherein the rebound regulation means comprises a friction member.

5. The seating apparatus of claim 4, further comprising:

one or more pivoting members disposed at respective upper ends of the one or more elongated support members of the front and rear leg assemblies;

a static member disposed substantially at the front portion of the seat; and a static member disposed substantially at the rear portion of the seat;

wherein the pivoting members respectively rotate about the static members at the front and rear portions of the seat.

6. The seating apparatus of claim 5, wherein the pivoting member comprises a compression chamber, and the friction member is disposed in the compression chamber.

7. The seating apparatus of claim 6, wherein the friction member applies pressure to the static member to thereby regulate the rebound response.

8. The seating apparatus of claim 7, wherein the pressure is adjustable.

9. The seating apparatus of claim 8, wherein the pressure is adjusted via an adjustment screw, adapted to direct a selected compressive force into the compression chamber.

10. The seating apparatus of claim 4, further comprising:

a front pivot arm disposed at respective upper ends of the one or more elongated support members of the front leg assembly;

a rear pivot arm disposed at respective upper ends of the one or more elongated support member of the rear leg assembly;

one or more front pivot sleeves disposed at respective ends of the front pivot arm, to thereby enclose the respective ends of the front pivot arm; and one or more rear pivot sleeves disposed at respective ends of the rear pivot arm, to thereby enclose the respective ends of the rear pivot arm;

wherein the front and rear pivot arms respectively rotate within the front and rear pivot sleeves.

* * * * *